US005927041A

United States Patent [19]

Sedlmeier et al.

[11] Patent Number: 5,927,041

[45] Date of Patent: Jul. 27, 1999

[54] MOUNTING RAIL

[75] Inventors: Andres Sedlmeier, Ummendorf; Fritz Hermann; Armin Hoffmann, both of Landsberg; Helmut Mirsberger, München; Jakob Dischinger, Eismerszell, all of Germany

[73] Assignee: Hilti Aktiengesellschaft, Schaan, Liechtenstein

[21] Appl. No.: 08/824,377

[22] Filed: Mar. 26, 1997

[30] Foreign Application Priority Data

Mar. 28, 1996 [DE] Germany ..... 196 12 275

[51] Int. Cl.[6] ..... E04C 2/38; G09F 7/18

[52] U.S. Cl. ..... 52/730.1; 52/731.7; 52/717.06; 52/39; 52/737.6; 248/49; 248/58

[58] Field of Search ..... 52/731.7, 39, 717.06, 52/737.6; 248/49, 58, 61, 65, 59

[56] References Cited

U.S. PATENT DOCUMENTS

| | | | |
|---|---|---|---|
| 2,375,513 | 5/1945 | Bach | 248/59 |
| 3,477,186 | 11/1969 | Birum, Jr. | 52/731.7 X |
| 4,488,844 | 12/1984 | Baubles . | |
| 5,118,069 | 6/1992 | Muhlethaler | 248/613 |
| 5,271,586 | 12/1993 | Schmidt | 248/58 |
| 5,704,571 | 1/1998 | Vargo | 248/58 |
| 5,794,400 | 8/1998 | Fisher et al. | 52/731.7 X |

FOREIGN PATENT DOCUMENTS

| | | | |
|---|---|---|---|
| 0638758 | 2/1995 | European Pat. Off. . | |
| 2472130 | 6/1981 | France . | |
| 2641667 | 3/1978 | Germany | 52/731.7 |
| 3513382 | 10/1986 | Germany . | |
| 1218264 | 1/1971 | United Kingdom . | |
| 2050549 | 1/1981 | United Kingdom . | |

*Primary Examiner*—Carl D. Friedman
*Assistant Examiner*—Brian E. Glessner
*Attorney, Agent, or Firm*—Anderson, Kill & Olick, P.C.

[57] ABSTRACT

A mounting rail, particularly for use in building construction, is formed by an elongated rail member (2) of approximately C-shaped cross section having a rear wall (3) with spaced openings (7*a*–7*d*) therethrough and pair of side walls (4*a*, 4*b*) extending from and at substantially right angles to the rear wall (3). The side walls have free edge sections spaced from the rear wall bent inwardly towards one another and forming cross members (5*a*, 5*b*) extending generally parallel to the rear wall with the inner edges of the cross members spaced apart and forming a slot (6) extending in the elongated direction of the rail member (2). Each side wall (4*a*, 4*b*) has shaped recesses (8*a*, 8*b*) extending for the length of the rail member (2). The shaped recesses (8*a*, 8*b*) are arranged symmetrically to one another in the opposite sidewalls (4*a*, 4*b*) and have a depth of (d) which does not exceed the width (b) of the cross members (5*a*, 5*b*) defining the slot (6).

9 Claims, 3 Drawing Sheets

MOUNTING RAIL

BACKGROUND OF THE INVENTION

The present invention is directed to a mounting rail, particularly for use in the building construction field.

In the building construction field a variety of installation arrangements are used in the electrical and plumbing trades, as well as in the heating, ventilation and air conditioning trades. To afford high flexibility, for example, when laying or installing cables, pipes and the like, such installation arrangements are not made directly to a base material such as a wall, ceiling or the floor. Instead, mounting rails, for suitably fastening and supporting the cables, pipes and the like, are mounted first to the base material. The use of mounting rails permits attachment locations for cables, pipes and the like which can be shifted quickly and easily, as required, without having to prepare new boreholes for anchoring the fastening elements. The fastening elements can be shifted very simply along the mounting rails and installed at the desired location. Further, mounting rails are used for other purposes, for example, for suspending a false ceiling to provide flexibility when installing lighting fixtures and the like. Mounting rails are used wherever great flexibility in the arrangement of fastening locations is desirable.

Mounting rails are known in the state of the art and are formed of rectangular or square cross-sections and are shaped on all four sides with dovetail-shaped recesses. In this way, fastening elements with attachment parts corresponding to the dovetail-shaped recesses are formed on all four external sides. Mounting rails with an approximately C-shaped cross section are also known. Such mounting rails are open on one side forming a slot and have a closed rear side secured to at base material or suspended from the base material. The fastening elements are inserted into a side wall or at the end into the open slot and mounted in the rail, for example, by twisting the attachment part. Some of these known C-shaped rails have inwardly directed toothed surfaces along the edges of the open slot. Such toothed surfaces interact with corresponding toothed surfaces on the attachment part of a fastening element and secure the attachment part against inadvertent shifting on the mounting rail.

These known mounting rails have advantages for the intended applications. For suspended applications, C-shaped rails are preferred, since they permit simple installation of the fastening elements for which attachment parts can be designed relatively simply. The suspended attachment of the fastening elements is effected easily, and the fastening elements in mounting rails with internal toothed surfaces can be shifted without great effort for releasing and repositioning the fastening elements. Mounting rails, with recesses shaped in a dovetailed fashion afford the possibility of attachments to the outside surfaces of the rail and are very suitable for rail arrangements where several rails are connected together, for example, to produce a frame.

SUMMARY OF THE INVENTION

Therefore, it is the primary object of the present invention to provide a mounting rail with universal uses. The mounting rail is compatible with various attachment systems to afford different types of fastenings most suitable for particular applications. A mounting rail is provided suitable for mounting on a ceiling, a wall or a floor and which also can be mounted at a distance from the supporting surface or base material. In particular, the mounting rail permits suspended arrangements and affords the production of frame-like arrangements.

In accordance with the present invention, a mounting rail, particularly useful in the building construction field, is formed of an elongated rail member having an approximately C-shaped cross section transversely of its length and with a rear wall provided with openings therethrough and laterally spaced sidewalls extending at right angles from the rear wall. The side walls have free edge sections spaced from the rear walls and the sections are bent inwardly toward one another forming two cross members extending essentially parallel to the rear wall with the inner edges of the cross members forming the boundary of a slot extending in the elongated direction of the mounting rail. Each side wall has shaped recesses extending for the length of the mounting rail. The shaped recesses in opposite side walls are disposed symmetrically to one another and have a depth not greater than the width of the cross members extending inwardly from the side walls.

Since the C-shaped rail has shaped recesses in the side walls, the mounting rail has universal uses and is suitable for direct attachment to a ceiling, a wall, or a floor or for installation at a distance from the supporting surface or base material. The C-shaped form of the rail, open along one side, permits fastening elements to be attached, the attachment parts can be simply introduced into the slot. In this way, the mounting rail of the invention can be used in accustomed manner with suspension elements. The shaped recesses, arranged symmetrically to one another in the side walls, increase the possible uses of the mounting rail, since attachment parts and connection parts for the rails, matched to the shaped recesses extending in the side walls along the rail, can be secured to the mounting rail. Therefore, mounting rails can be assembled into a frame system. The mounting rail can also be used to fasten elements secured to the mounting rail or engaged in to the open slot affording access to the interior of the rail. At the same time, the attachment parts can be inserted or suspended in a hook-like fashion in the shaped recesses. The combination of the elongated slot and the elongated shaped recesses also permits the attachment of several different fastening elements along the same elongated section of the mounting rail. This is advantageous, if, for example, a side wall or a slot of the mounting rail is not accessible or is accessible only with difficulty due to the spatial relationships involved. In the past, the attachment location had to be shifted or the mounting rail moved. Instead, the attachment location can be retained by selecting a fastening element adapted to the given spatial conditions with an attachment part of the fastening element matched to the accessible shaped recesses. Since the depth of the recesses does not exceed the width of the cross members defining the elongated slot, the slender line of the mounting rail is retained. The shaped recesses in the side walls of the mounting rail increase the bending stiffness of the rail and its permissible load. As a result, a lighter mounting rail can be formed.

It is advantageous if the spaced wall surfaces which extend inwardly from the facing inner surfaces of the side walls are formed with symmetrical recesses at a distance from one another corresponding to the width of the slot. In this manner, the spaced wall surfaces of the shaped recesses, projecting into the interior of the rail, do not interfere with the attachment parts of the fastening elements which extend into the elongated slot, and the attachment parts can be shifted in the elongated direction in the accustomed manner along the mounting rail.

Since the corresponding wall sections of the shaped recesses, formed by the symmetrical shaped recesses and projecting outwardly from the outside surfaces of the side walls are at distance from one another corresponding to the width of the rear wall, the total width of the mounting rail corresponds exactly to the width of the rear wall. The outside dimensions of the mounting rail are not altered by the elongated shaped recesses formed in the side walls.

In a preferred embodiment of the invention, the shaped recesses have a dovetail-like cross section. At the same time they afford at least one groove-like recess in each sidewall extending in the sidewall in the direction towards the opposite side wall. The groove-like recesses are undercut so that the width of the slot formed by the recess is less at the surface of the side wall than at the base of the recess. The elongated recesses or grooves with a dovetail-like cross section in the two sidewalls result in hook-like projections in the interior of the mounting rail. Such hook-like projections permit the fastening elements to be easily attached. The fastening elements, embracing the mounting rail, can also be hooked very easily into the elongated recesses or grooves. The dovetail-like elongated recesses are constructed particularly for accommodating correspondingly formed attachment parts of the fastening elements which can be secured to the outside surfaces of the side walls. Moreover, the dovetail-like shape has the advantage that installed fastening elements, particularly when engaged laterally, are supported in the elongated recess.

Groove-like recesses are advantageously formed symmetrically with their side surfaces inclined at an angle in the range of about 10° to about 25° to a line perpendicular to the side walls of the mounting rail. The angle of inclination of the side surfaces of the groove-like recesses affords hook-like attachment regions dimensioned adequately deeply. The symmetrical construction of the groove-like recesses ensures comparable relationships for the attachment of the fastening elements in all positions of the mounting rail. In particular, preferred positions for attachments to the side walls are avoided by section arrangement.

It is advantageous for the bending strength of the mounting rail if the cross members forming the slot have a wall thickness greater than that on the side walls. The increase in wall thickness is gained preferably by doubling the cross member over on itself toward the associated side wall. Since the wall thickness of the cross members is increased, the permissible load of the mounting rail is also increased.

Increasing the wall thickness of the cross members has the additional advantage that the surfaces of the cross members, facing the rear wall, can be knurled or provided as toothed-like surface. In combination with suitably shaped attachment parts, the knurling or toothing permits a preliminary securement of the fastening elements. After the fastening elements are secured, the permissible transverse load is increased by the knurling or toothed surfaces.

The possibilities of attaching different fastening elements are increased further in the case of mounting rails incorporating the present invention due to the fact that through openings, arranged in the spacing of the through openings in the rear wall or as a whole number multiple of the spacings, are provided in the side walls. For example, bolts, for suspending or fixing other elements, can be passed to the openings in the side walls. As an example, cable ties can be easily passed through the openings in the side walls for tying cables together. Since the openings in the side walls are arranged in a spacing or in a whole number spacing of the spacing of the openings through the rear wall, it is possible avoid the occurrence of openings with saw cuts at the edge of the mounting rail. When the mounting rails are cut to length in the region between rail wall openings, it is ensured the saw cut is not made through openings in the side walls.

Advantageously, the rear wall openings form a periodic sequence of openings of different diameters and shapes. This permits the use of different types of fastening elements with different diameters and shapes optimized for the particular application and/or for the base material supporting the mounting rail. The openings through the rear wall are arranged in a periodically repeating sequence.

A particularly good ratio of weight of the mounting rail to the permissible load results when the walls are in the range of about 0.5 mm to 2.0 mm thick. For corrosion protection reasons, the mounting rail is formed of steel plate which has been galvanized and preferably pre-galvanized, or is formed of a stainless steel alloy.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE INVENTION

Figure 1:
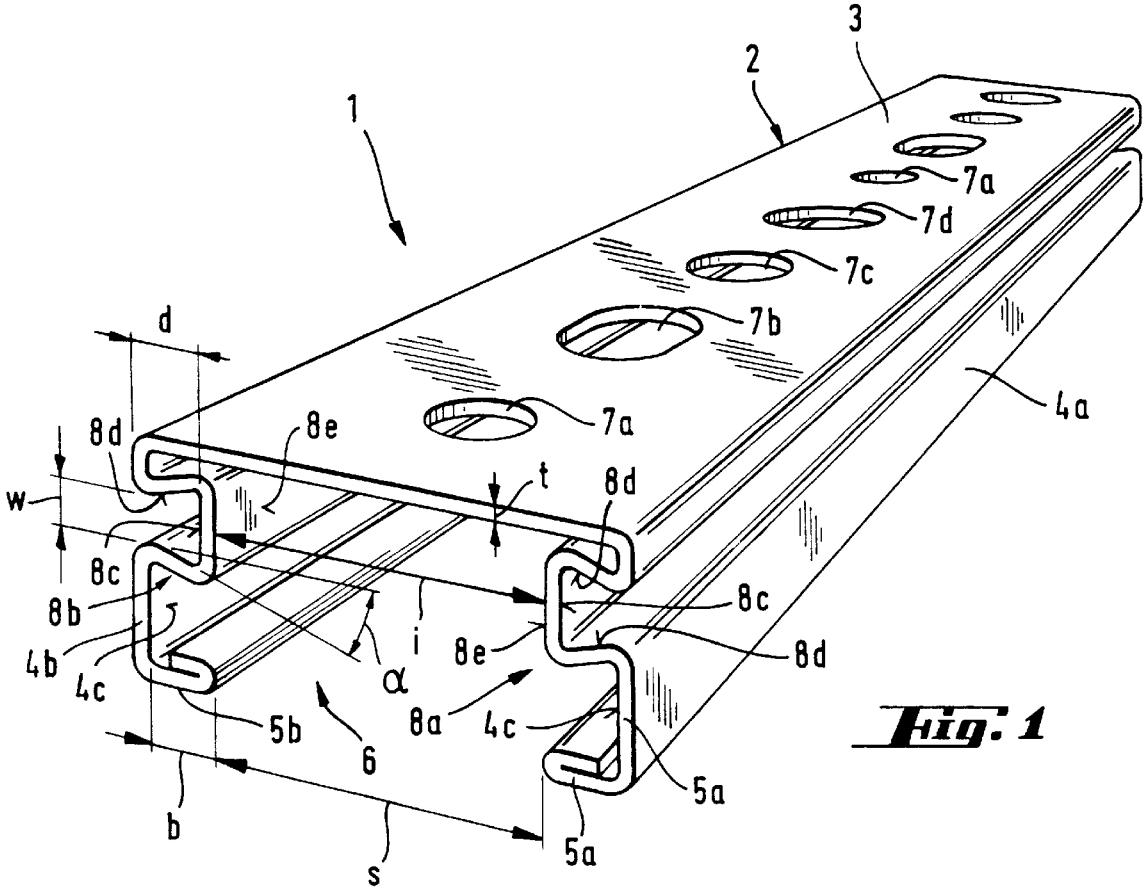
FIG. 1 is a first embodiment of a mounting rail incorporating the present invention and shown in perspective.
Figure 2:
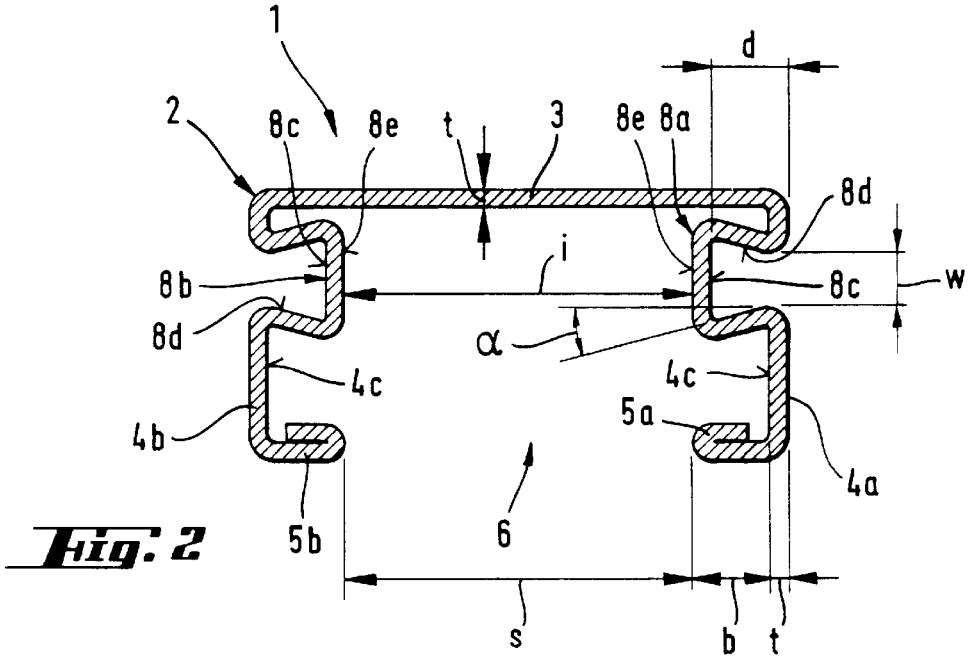
FIG. 2 is a transverse cross sectional representation of the mounting rail displayed in FIG. 1.

The first embodiment of the mounting rail 1 of the present invention, shown in FIGS. 1 and 2, has an elongated rail member 2 with an approximately C-shaped cross section transverse of the elongated direction and, preferably, is formed of a single strip of galvanized or stainless steel plate. The rail member 2 has a planar rear wall 3 with side walls 4*a* and 4*b* extending outwardly from the elongated edges of and perpendicularly to the rear wall 3. The side walls 4*a*, 4*b* have free end sections spaced from the rear wall and bent inwardly at approximately right angles to the side walls and forming cross members 5*a*, 5*b* arranged parallel to the rear wall 3 with the inner edges of the cross members defining a slot 6 extending in the elongated direction of the mounting rail 1. The thickness of the cross members 5*a*, 5*b* is greater than the thickness of the sidewalls 4*a*, 4*b*. This increased thickness is achieved by doubling the free end sections of the side walls over on themselves. The width t of the side walls 4*a*, 4*b* and of the rear walls 3 of the mounting rail is in a range of about 0.5 mm to 2.0 mm. With the free end sections of the side walls doubled over on themselves, the wall thickness of the cross members is about twice the wall thickness t of the side walls. The surfaces of the cross members 5*a*, 5*b* facing towards the rear walls 3 can be knurled or provided with a toothed surface, not shown. The rear wall of the mounting rail 1 has through openings 7*a*, 7*b*, 7*c*, 7*d* spaced apart in the elongated direction and the arrangement of the openings; is repeated periodically.

In accordance with the invention, the sidewalls 4*a*, 4*b* of the mounting rail have shaped recesses 8*a*, 8*b* extending in the elongated direction and located adjacent to the rear wall 3. In the embodiment shown in FIGS. 1 and 2, the shaped recesses 8*a*, 8*b* have a dovetail-like cross-section.

In particular, the recesses are groove-like recesses. The width w of the groove-like recesses 8*a*, 8*b* is smaller at the opening in the side walls 4*a*, 4*b* than in the region of the base 8*c* of the recesses. The recesses are constructed symmetrically. The side surfaces 8*d* of the recesses are inclined at an angle γ in the range of about 10° to 25° relative to a line perpendicular to the side walls 4*a*, 4*b*. The depth d of the groove-like recesses 8*a*, 8*b* is such that it does not exceed the width b of the cross members 5*a*, 5*b* extending from the slot to the corresponding side wall 4*a*, 4*b*. The base sections 8*c*, formed by the groove-like recesses 8*a*, 8*b* on either side of the slot 6, projecting inwardly from the inside surfaces 4*c* of the side wall 4*a*, 4*b*, are spaced at a distance i from one another corresponding to the width s of the slot 6.

Figure 3:
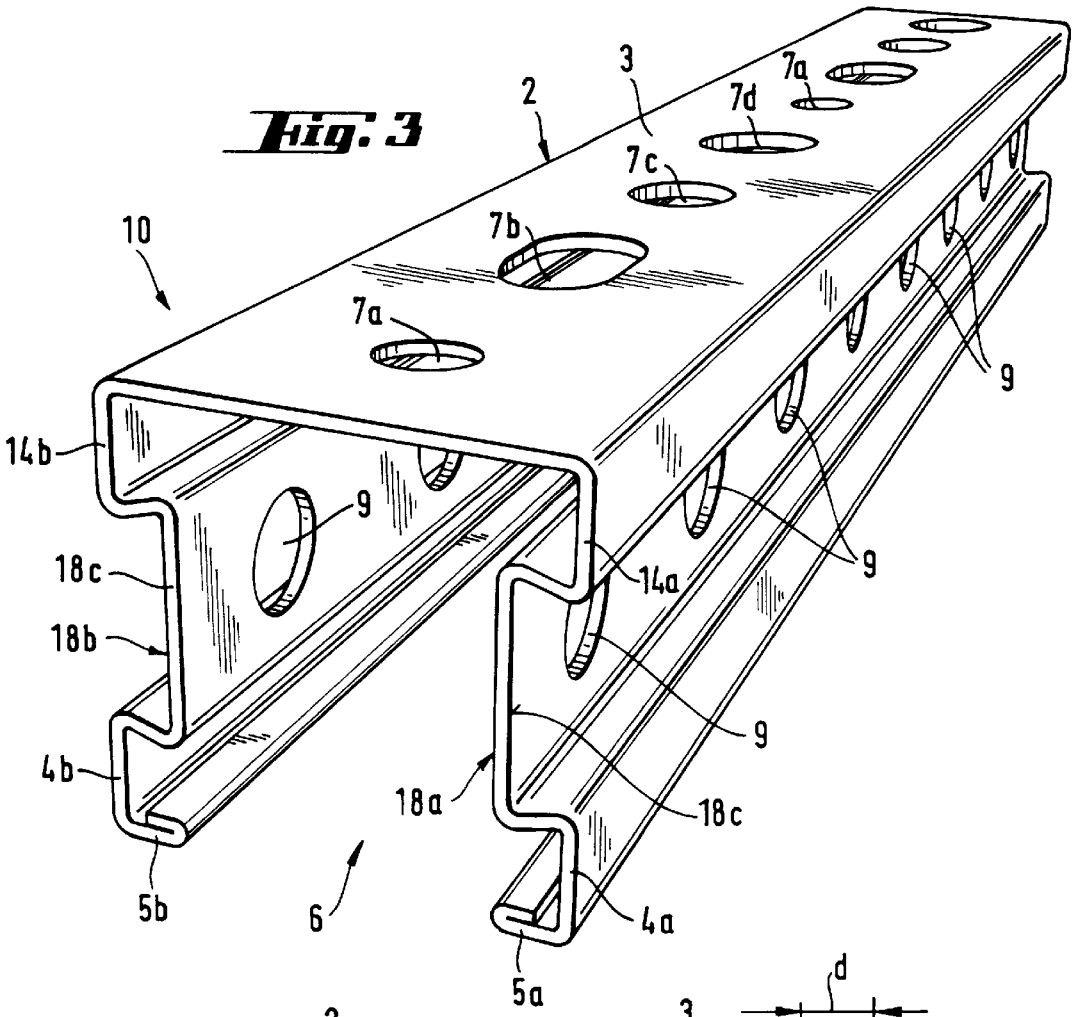
FIG. 3 is a perspective view of a second embodiment of a mounting rail.
Figure 4:
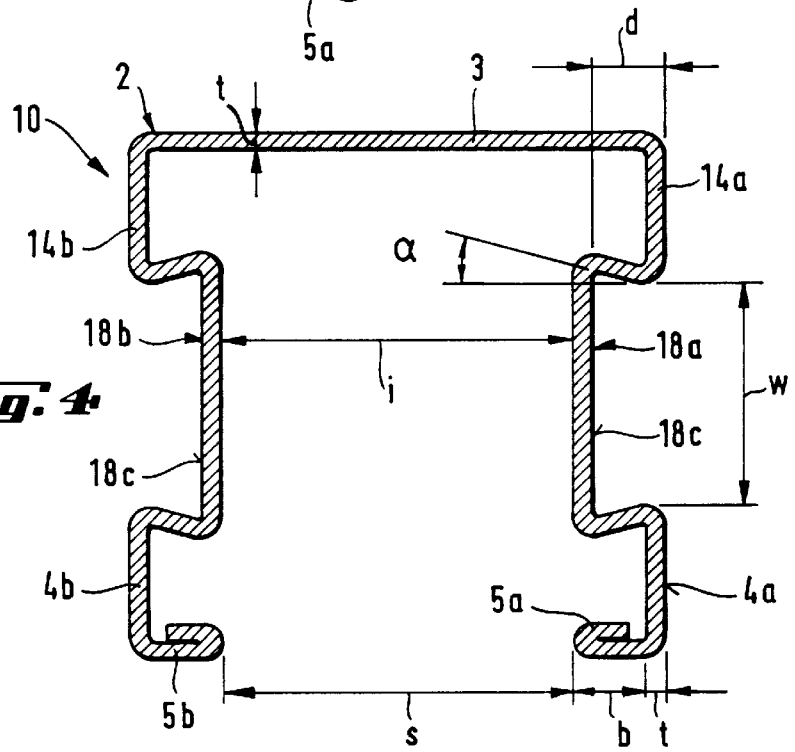
FIG. 4 is transverse cross sectional showing of the mounting rail in FIG. 3.

A second embodiment of a mounting rail 10 of the present invention is shown in FIGS. 3 and 4. In contrast to the mounting rail 1 displayed in FIGS. 1 and 2, the groove-like shaped recesses 18*a*, 18*b* are not adjacent to the rear wall 3 of the mounting rail. In this embodiment, side wall sections 14*a*, 14*b* extend from the rear wall 3 to the opening into the groove-like shaped recesses 18*a*, 18*b* and on the other of the opening of the groove-like shaped recesses 18*a*, 18*b*, the side walls 4*a*, 4*b* extend to the cross members 5*a*, 5*b* forming the opposite edges of the slot 6 located opposite the rear wall 3. The base 18*c* of the groove-like recesses 18*a*, 18*b* is wider than in the embodiment of FIGS. 1 and 2. As shown, the width or height of the base 18*c* of the recesses is about half the overall width or height of the sidewalls 4*a*, 4*b*. This increased width allows the base 18*c* of the recesses 18*a*, 18*b* to be provided with through openings, note FIG. 3, arranged in the spacing of the through openings 7*a*–7*d* in the rear wall 3. The side walls 4*a*, 4*b* and the side wall section 14*a*, 14*b* have the same width or height. Accordingly, they can be engaged by the same fastening element in the direction of the rear wall 3 as well as from the direction of the slot of the mounting rail 10.

Figure 5:
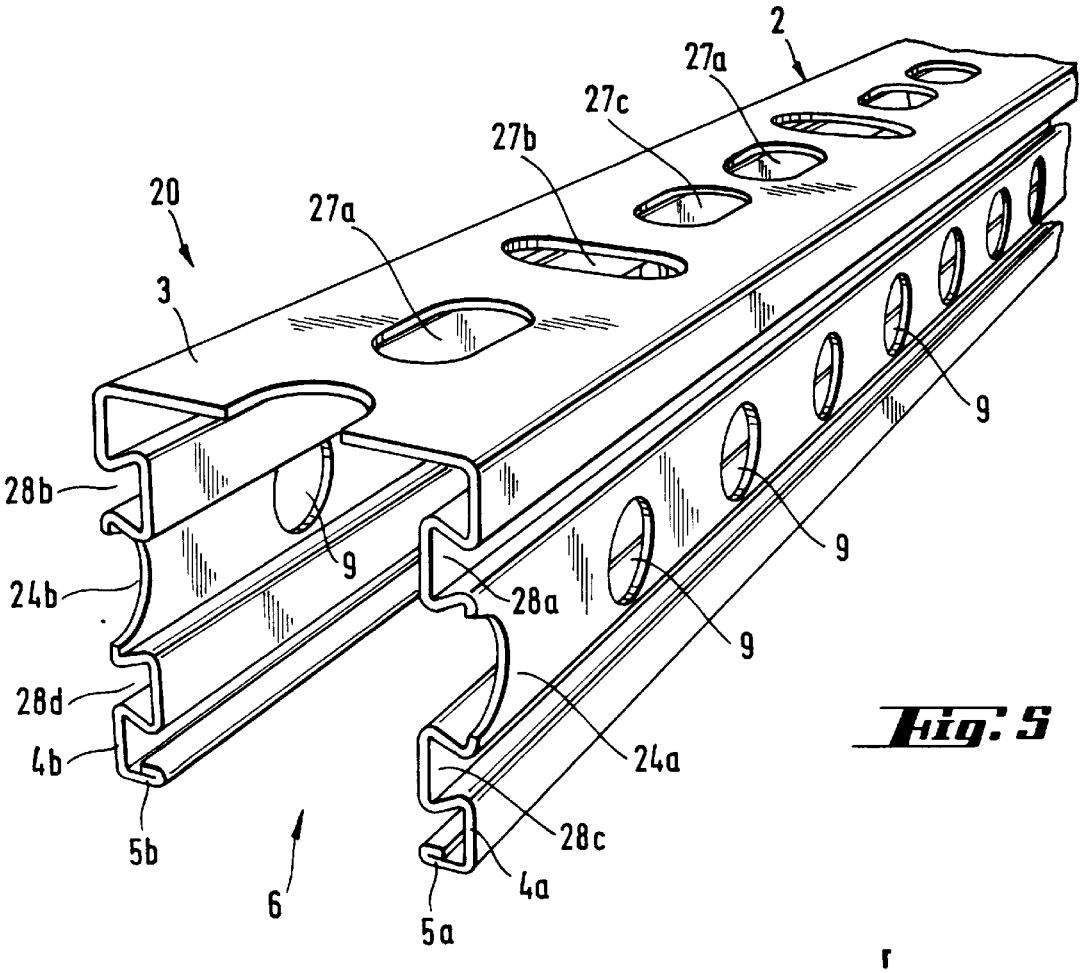
FIG. 5 is third embodiment of a mounting rail displayed in perspective.

In FIG. 5 a third embodiment is shown of a mounting rail 20. In this embodiment, the shaped recesses in the side walls 4*a*, 4*b* provide a pair of groove-like shaped recesses 28*a*, 28*c* and 28*b*, 28*d*. The groove-like recesses are separated from one another by a planar side wall section 24*a*, 24*b* in which through openings 9 are formed arranged in the spacing of the periodically repeated spacing of the through openings 27*a*, 27*b*, 27*c* in the rear wall 3. The groove-like shaped recesses arranged in pairs in the side walls 4*a*, 4*b*, are formed symmetrically with respect to the overall width or height of the side walls. The distance of one groove-like recess from the rear wall 3 is equal to the distance of the other groove-like recess from the cross members 5*a* or 5*b* forming the boundaries of the elongated slot. In this manner, a fastening element, embracing the rail, can be pushed from the slot side or from the direction of the rear wall over the mounting rail and suspended in the groove-like shaped recesses.

Figure 6:
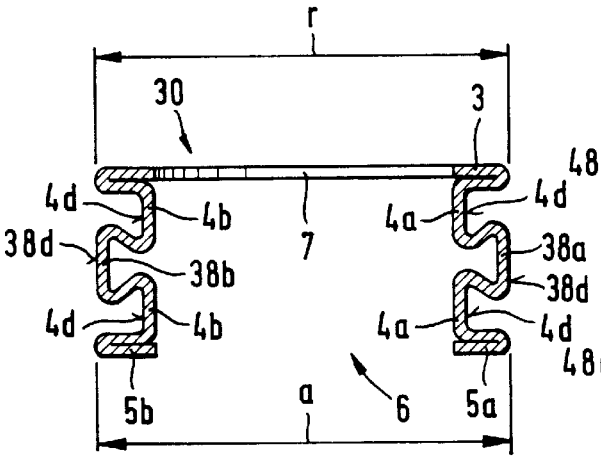
FIGS. 6 and 7 illustrate a 4th and 5th embodiment of mounting rails set forth in cross section.
Figure 7:
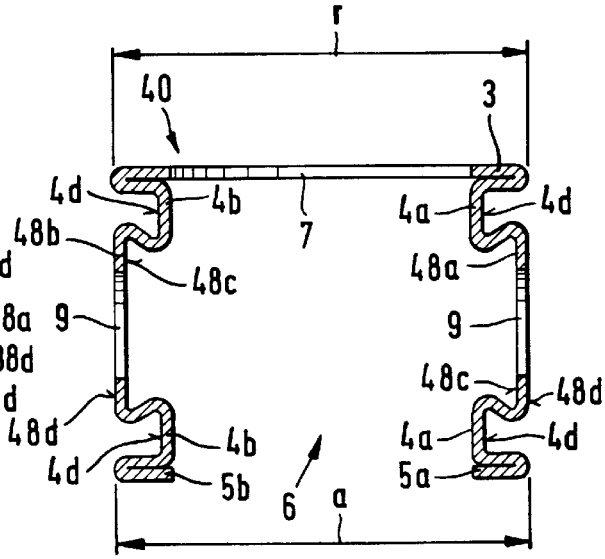

In FIGS. 6 and 7 a fourth and fifth embodiment of mounting rails 30, 40 are shown in transverse cross section. The common feature of the two embodiments is that the groove-like shaped recesses 38*a*, 38*b* and 48*a*, 48*b* are disposed centrally with respect to the height of the side walls 4*a*, 4*b*. In both embodiments of the mounting rails 30, 40, the groove-like recesses 38*a*, 38*b* and 48*a*, 48*b* are spaced outwardly with respect to the outer surfaces 4*d* of the side walls 4*a*, 4*b*. Moreover, the distance a between the side wall sections 38*d* and 48*d* formed by the shaped recesses 38*a*, 38*b*, 48*a*, 48*b* correspond to the width r of the rear wall 3. The groove-like shaped recesses 38*a*, 38*b* and 48*a*, 48*b* are basically dovetail-like shaped. The groove-like shaped recesses 38*a*, 38*b* and 48*a*, 48*b* open into the inside of the side walls 4*a*, 4*b* and face one another. In both embodiments of the mounting rails 30, 40, through openings 7 are shown in the rear wall. In the embodiment of the mounting rail 40, illustrated in FIG. 7, the shaped recesses are inverted relative to the mounting rail 10 displayed in FIGS. 3 and 4. The base 48*c* of the groove-like shaped recesses 48*a*, 48*b* have through openings 9 arranged in the spacing of the through openings 7 in the rear wall 3.

The mounting rail of the present invention has been described using different embodiments. The mounting rails can have a square or rectangular transverse cross section. If the cross section is rectangular, the height of the side walls 4*a*, 4*b* can be less or greater than the width of the rear wall 3. The width of the rear wall 3 can be in the range of about 20 mm to 40 mm. The height of the side walls can be in the range of about 10 mm to about 50 mm. To facilitate cutting the mounting rail to length, a marking, preferably on a centimeter scale, can be provided in the region of the free ends of at least one of the side walls 4*a*, 4*b* and/or in the rear wall 3.

We claim:

1. A mounting rail for use in the building construction field, comprising an elongated rail member (2) having a length and an approximately C-shaped transverse cross section with a planar rear wall (3) extending in the elongated direction and having openings (7*a*–*d*, 27*a*–27*c*) extending therethrough and spaced apart in the elongated direction, said rear wall having a width (r) extending transversely of the elongated direction and a pair of laterally spaced side walls (4*a*, 4*b*) extending in the elongated direction and connected to and extending in a plane at substantially right angles from said rear wall, said side walls having a wall thickness, said side walls each having a free edge section extending in the elongated direction and spaced from said rear wall, said free edge sections bent inwardly from the plane of said side walls towards one another and each forming a cross member (5*a*, 5*b*) extending substantially parallel to said rear wall and perpendicular to said side walls and having inner edges disposed in spaced relation forming a slot (6) therebetween having a width (s) less than the width (r) of said rear wall extending in the elongated direction, each said cross member having a width (b) extending transversely of the elongated direction, said rail member having a partially closed interior formed by said rear wall and side walls, each said side wall having shaped recesses (8*a*, 8*b*; 18*a*, 18*b*; 28*a*, 28*b*; 38*a*, 38*b*; 48*a*, 48*b*;) extending for the length of the said rail member (2), said shaped recesses being arranged symmetrically to one another and having a depth (d) not greater than the width (b) of said cross members (5*a*, 5*d*) and said shaped recesses each having an opening in the plane of said side walls and extending inwardly from said side walls so that said openings face outwardly from the interior of said rail members.

2. A mounting rail, as set forth in claim 1, wherein said shaped recesses (8*a*, 8*b*; 18*a*, 18*b*; 28*a*–28*d*) have wall sections extending at right angles to said rear wall (3) and spaced inwardly from inwardly facing surfaces of said side walls (4*a*, 4*b*) and are spaced apart in the interior of said rail member by a distance (i) corresponding to the width (s) of said slot (6).

3. A mounting rail, as set forth in claim 1 wherein said shaped recesses (38*a*, 38*b*; 48*a*, 48*b*) have wall sections (38*d*, 48*d*) extending at right angles to said rear wall (3) and projecting outwardly from outer surfaces (4*d*) of the said side walls (4*a*, 4*d*) and have a distance (a) therebetween corresponding to the width (r) of said rear wall (3).

4. A mounting rail, as set forth in claim 1, 2 or 3, wherein said shaped recesses (8*a*, 8*b*; 18*a*, 18*b*; 28*a*–28*d*; 38*a*–38*b*; 48*a*, 48*b*) in each said side wall (4*a*, 4*b*) comprising at least one groove-like recess having a dovetail-like transverse cross section with said groove-like recess being undercut and having a smaller opening width (w) in said side wall (4*a*, 4*b*) than a width of a base (8*c*) of said groove-like recess spaced inwardly from said opening into said recess.

5. A mounting rail, as set forth in claim 4, wherein said groove-like shaped recesses (8*a*, 8*b*; 18*a*, 18*b*; 28*a*–28*d*; 38*a*, 38*d*; 48*a*, 48*b*) are formed symmetrically and have opposite side surfaces (8*d*) extending between the opening of said recesses and the base thereof inclined at an angle ($\alpha$) in the range of about 10°–25° with respect to a line perpendicular to said side walls (4*a*, 4*d*) of said rail member (10).

6. A mounting rail, as set forth in claim 1, 2 or 3, wherein said cross members (5*a*, 5*b*) extending parallel to said rear wall (3) and bounding said slot (6) have a wall thickness greater than the wall thickness of said side walls (4*a*, 4*b*) and the increased thickness of said cross members being achieved by bending said free end section over upon themselves in the direction of the associated said side wall (4*a*, 4*b*).

7. A mounting rail, as set forth in claim 1, 2 or 3, wherein said side walls (4*a*, 4*b*) have through openings (9) arranged in one of the spacings of said openings (7*a*–7*d*; 27*a*–27*c*) and as whole number multiple of the spacing of said openings in said rear wall (3).

8. A mounting rail, as set forth in claim 7, wherein said openings (7*a*–7*d*; 27*a*–27*c*) in said rear wall (3) are arranged in a periodic sequence of openings of different diameters and shapes.

9. A mounting rail, as set forth in claim 1, 2 or 3, wherein said rail member (2) is formed of steel plate of one of a galvanized and rust proof type and has a thickness (t) in the range of 0.5 mm to 2.0 mm.

* * * * *